US005145180A

United States Patent [19]

Oka

[11] Patent Number: 5,145,180

[45] Date of Patent: Sep. 8, 1992

[54] GOLF BALL

[75] Inventor: Kengo Oka, Kobe, Japan

[73] Assignee: Sumitomo Rubber Industries, Ltd., Hyogo, Japan

[21] Appl. No.: 668,109

[22] Filed: Mar. 12, 1991

[30] Foreign Application Priority Data

Oct. 12, 1990 [JP] Japan ..... 2-273529

[51] Int. Cl.[5] ..... A63B 37/14

[52] U.S. Cl. ..... 273/232; 40/327

[58] Field of Search ..... 273/232, 220, 62; 40/327

[56] References Cited

U.S. PATENT DOCUMENTS

| | | | |
|---|---|---|---|
| 4,744,564 | 5/1988 | Yamata | 273/232 |
| 4,848,766 | 7/1989 | Oka et al. | 273/232 |
| 4,973,057 | 11/1990 | Morell | 273/232 |
| 5,044,638 | 9/1991 | Nesbitt et al. | 273/232 |

FOREIGN PATENT DOCUMENTS

| | | |
|---|---|---|
| 0371866 | 6/1990 | European Pat. Off. . |
| 2-152476 | 6/1990 | Japan . |
| 2176409 | 12/1986 | United Kingdom . |
| 2211743 | 12/1989 | United Kingdom . |

*Primary Examiner*—George J. Marlo

[57] ABSTRACT

A golf ball has dimples arranged in eight spherical equilateral triangles obtained by projecting, on the imaginary spherical surface of the golf ball, the ridge lines of a regular octahedron inscribing the imaginary spherical surface. Three great circles corresponding to the ridge lines being projected on the spherical surface. One great circle coinciding with a mold seam is formed as the sole great circle unintersecting dimples and the other two great circles intersect dimples. Between 300 to 550 dimples are formed in the golf ball with the dimples being equivalently arranged in each of the eight spherical equilateral triangles.

2 Claims, 9 Drawing Sheets

FIG. 5
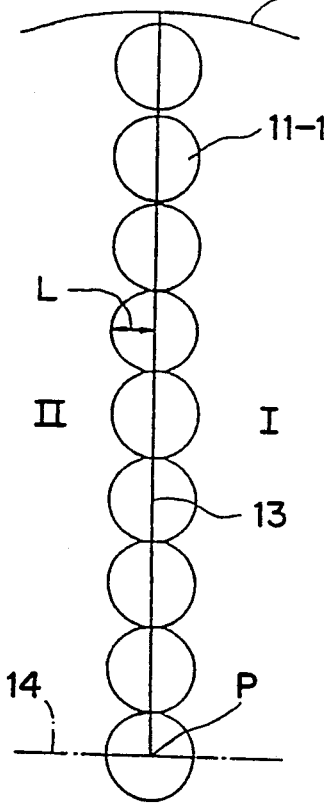
FIG. 6(A)
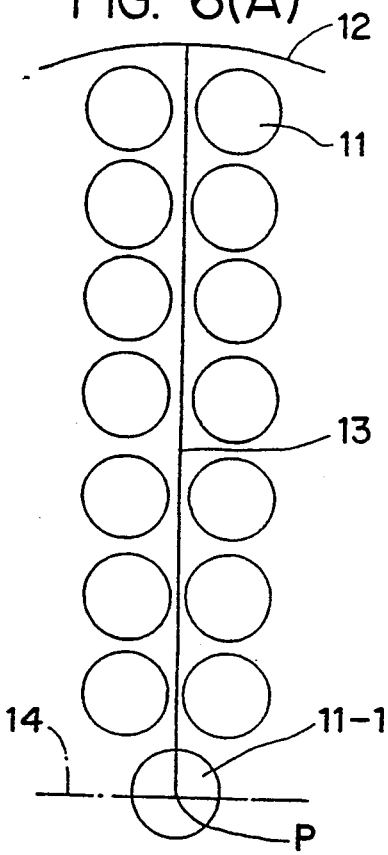
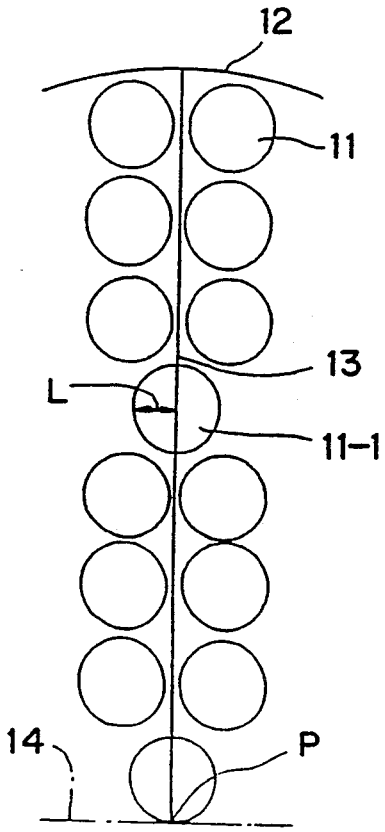
FIG. 6(B)

FIG. 7(A)
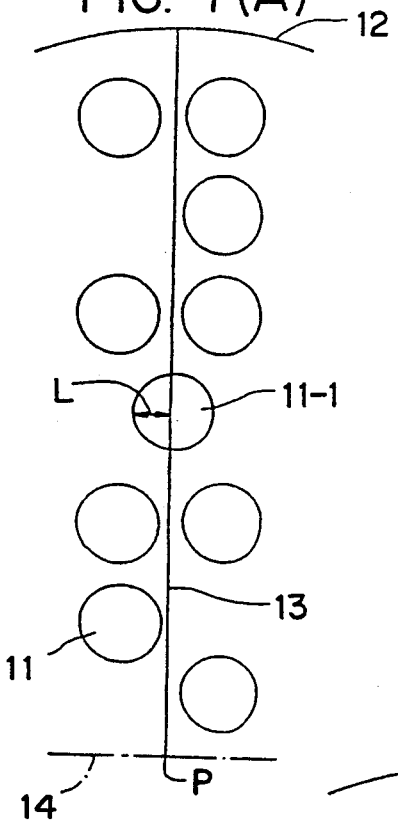
FIG. 7(B)
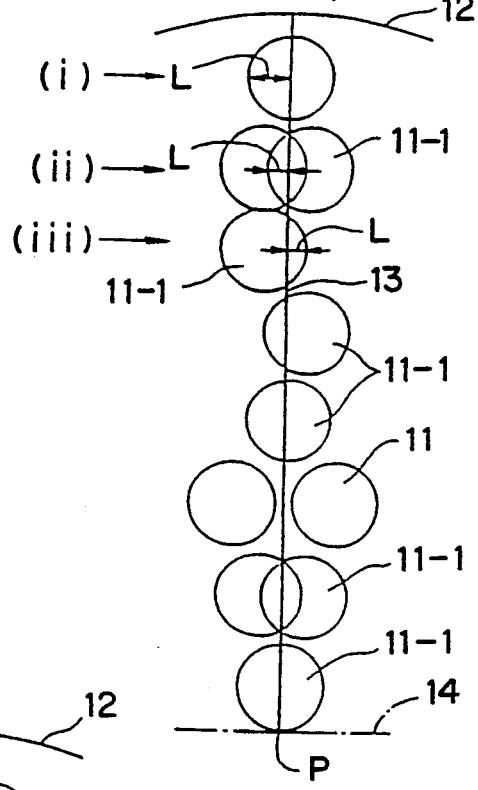
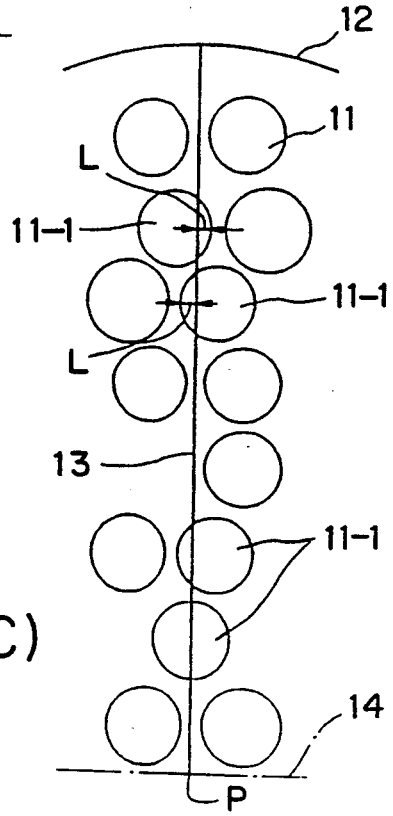
FIG. 7(C)

GOLF BALL

BACKGROUND OF THE INVENTION

1. Field of the Invention

The present invention relates to a golf ball, and more particularly, to the golf ball having an octahedral dimple arrangement which improves the flight performance of the golf ball.

2. Description of the Related Arts

Normally, 300 to 550 dimples are formed on the surface of a golf ball so as to increase the flight distance thereof by improving the aerodynamic characteristic thereof. Of various proposals regarding dimple arrangements, regular octahedral arrangement is most widely adopted because dimples are arranged symmetrically and regularly.

As shown in FIGS. 10, 11 and 12, according to the regular octahedral arrangement, the spherical surface of a golf ball 1 is divided into eight spherical equilateral triangles by projecting, on the spherical surface of the golf ball 1, the ridge lines 2*a* of a regular octahedron 2 inscribing the spherical surface of the golf ball 1 and dimples are equivalently arranged in each spherical triangle as shown in FIG. 12. The ridge lines 2*a* projected on the spherical surface of the golf ball 1 form three great circles 3, 4, and 5 on which dimples 6 are not arranged. That is, the golf balls 1 has on the surface thereof three great circles which do not intersect the dimples 6.

Normally, since the golf ball is molded by a pair of upper and lower semispherical molds, dimples are not arranged on the seam between the upper and lower molds so as to facilitate the removal of a burr formed when the golf ball is molded. Therefore, in the regular octahedral dimple arrangement, the great circle 3 coincides with the seam.

The main object of the dimple is to accelerate the transition of the turbulent flow of a boundary layer and increase the aerodynamic characteristic of the golf ball in order to increase the flight distance of the golf ball. Therefore, it is well known to those skilled in the art to effectively arrange dimples to accelerate the transition of the turbulent flow of the boundary layer. From this point of view, various proposals have hitherto been made to improve the regular octahedral dimple arrangement on the surface of the golf ball. According to the dimple arrangement proposed by Japanese Patent Laid-Open Publication No. 62-79072 (unexamined), dimples of large and small diameters are arranged on the surface of the golf ball. According to the dimple arrangement proposed by Japanese Patent Laid-Open Publication No. 2-152476 (unexamined), dimples of more than three different diameters are arranged on the surface of the golf ball.

The regular octahedral dimple arrangements proposed by these prior patent applications are capable of improving the flight performance of the golf ball to some extent, however, there is still a problem due to three great circles being formed on the golf ball.

Namely, when the golf ball flies with backspin, dimples arranged on a circumference which rotates fastest in its backspin have the most affect on the flight distance of the golf ball. When the circumference which rotates fastest in its backspin coincides or approximately coincides with a great circle having no dimples arranged thereon, dimple effect is reduced, so that the flight distance of the golf ball becomes shorter. In the octahedral dimple arrangement, there is a great possibility that the circumference which rotates fastest in its backspin coincides or approximately coincides with one of the three great circles because the golf ball has three great circles unintersecting dimples. Therefore, the flight distance of the golf ball is varied due to one of the great circles formed thereon.

SUMMARY OF THE INVENTION

It is therefore the object of the present invention to provide a golf ball having a regular octahedral dimple arrangement and a favorable aerodynamic symmetrical property so as to increase the flight distance thereof by providing only one great circle unintersecting dimples.

In accomplishing these and other objects, the present invention provides a golf ball having dimples arranged in eight spherical equilateral triangles obtained by projecting, on the imaginary spherical surface of the golf ball, the ridge lines of a regular octahedron inscribing the imaginary spherical surface. Of three great circles corresponding to the ridge lines projected on the spherical surface, one great circle coinciding with a seam between a pair of molds is formed as the sole great circle unintersecting dimples and the other two great circles intersect dimples.

According to the preferred golf ball, dimples are arranged equivalently in each of the eight spherical equilateral triangles.

Preferably, each dimple intersecting the two great circles corresponding to the ridge lines projected on the spherical triangle protrudes from one spherical equilateral triangle to an adjacent spherical equilateral triangle in the length of more than 0.3 mm.

In order to equalize to each other the aerodynamic characteristic of the vicinity of the seam corresponding to the great circle is formed and unintersecting dimples and the vicinity of the poles having dimples densely arranged, the surface of the golf ball is divided into an S spherical zone in the vicinity of the seam and a P spherical zone in the vicinity of the poles P. The dimple specification of S and P zones are set so that assuming that RS is a value obtained by dividing the total volume of all dimples arranged in S zone by the surface area of S zone of the imaginary spherical surface and RP is a value obtained by dividing the total volume of all dimples arranged in P zone by the surface area of P zone of the imaginary spherical surface, RS/RP is set in the range:

$$0.95 \leqq RS/RP \leqq 1.20$$

According to the above construction, since the golf ball has only one great circle corresponding to the seam not intersecting dimples, the possibility that a circumference which rotates fastest in its backspin coincides or approximately coincides with the great circle can be reduced, so that the flight distance of the golf ball can be increased by improving the aerodynamic characteristic thereof.

In addition, dimples of larger volumes are arranged in S zone in the vicinity of the seam on which the great circle unintersecting dimples is formed. Dimples of smaller volumes are arranged in P zone, in the vicinity of the poles, in which dimples are densely arranged. Therefore, the aerodynamic symmetrical property of the golf ball can be improved. That is, the aerodynamic characteristic of the golf ball is equalized between a case where a circumference which rotates fastest in its backspin coincides with the seam and a case where a circumference which rotates fastest in its backspin coincides with the pole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

These and other objects and features of the present invention will become apparent from the following description taken in conjunction with the preferred embodiments thereof with reference to the accompanying drawings which are given by way of illustration only, and thus are not limitative of the present invention, and in which:

FIG. 5 is a view showing an enlarged principal portion of FIG. 1A;

FIGS. 6A and 6B are views each showing a modification for intersecting dimples and a great circle with each other;

FIGS. 7A, 7B, and 7C are views each showing, similarly to FIG. 5, a modification for intersecting dimples and a great circle with each other;

DETAILED DESCRIPTION OF THE INVENTION

Figure 1A:
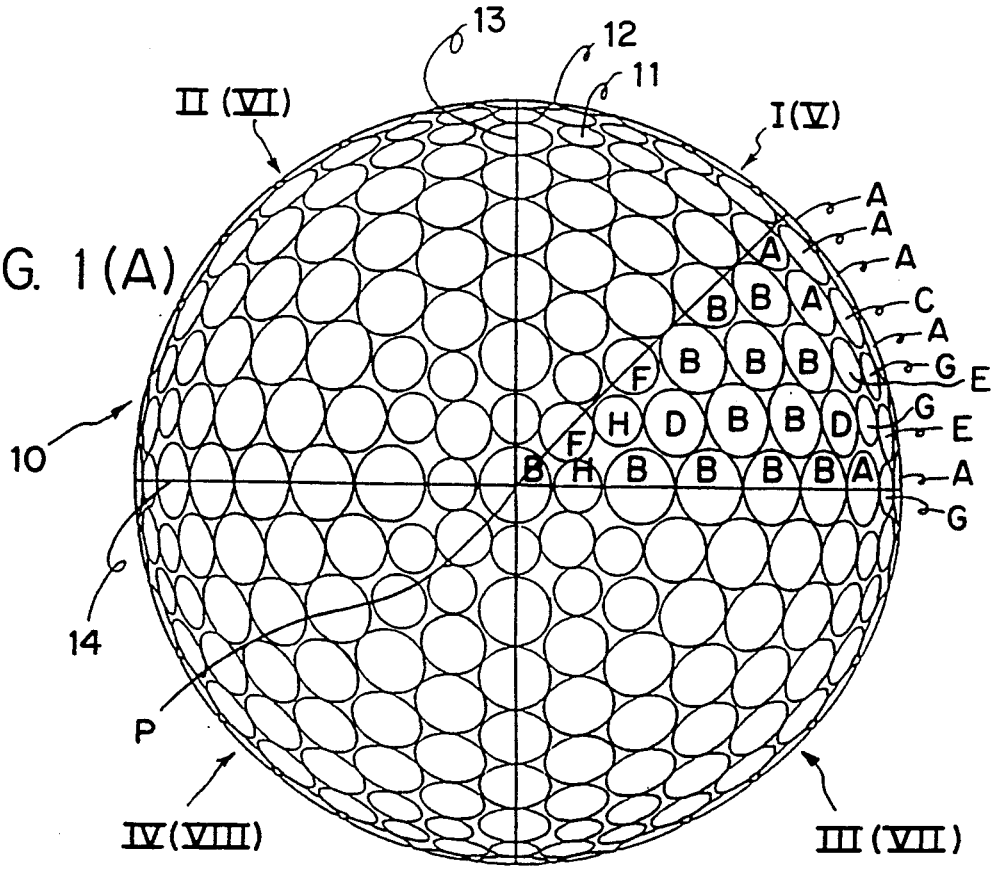
FIG. 1A is a plan view showing a golf ball according to the embodiment of the present invention.

Before the description of the present invention proceeds, it is to be noted that like parts are designated by like reference numerals throughout the accompanying drawings.

Figure 1B:
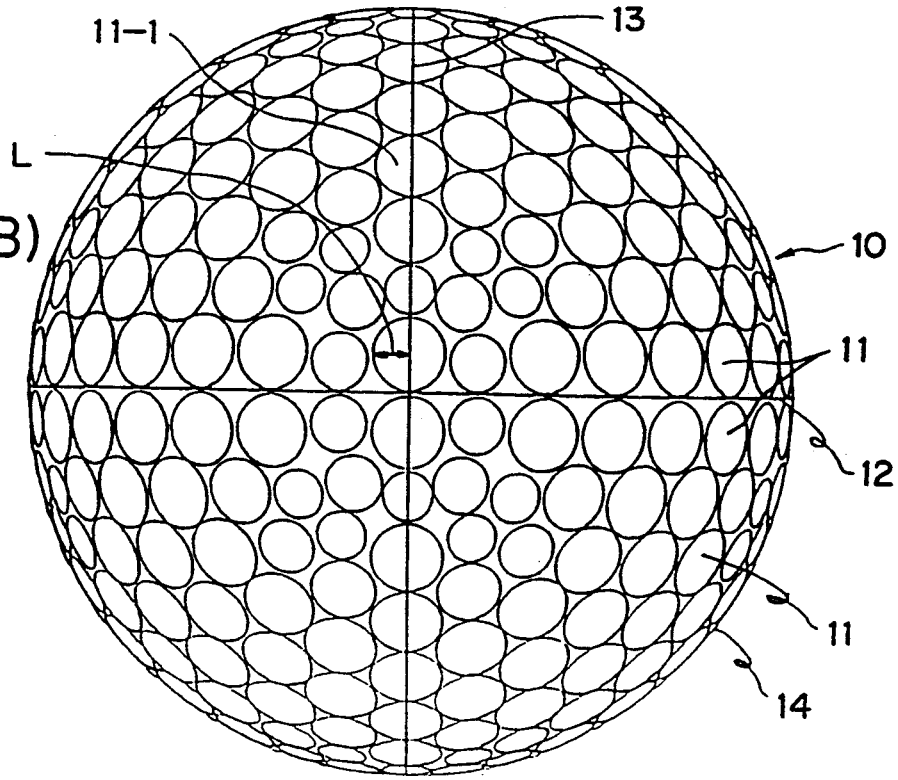
FIG. 1B is a front view showing the golf ball shown in FIG. 1A.

FIG. 1A is a plan view, showing a golf ball 10 according to the present invention, viewed with the pole P of the golf ball 10 placed uppermost. FIG. 1B is a front view showing the golf ball 10 shown in FIG. 1A.

Figure 11:
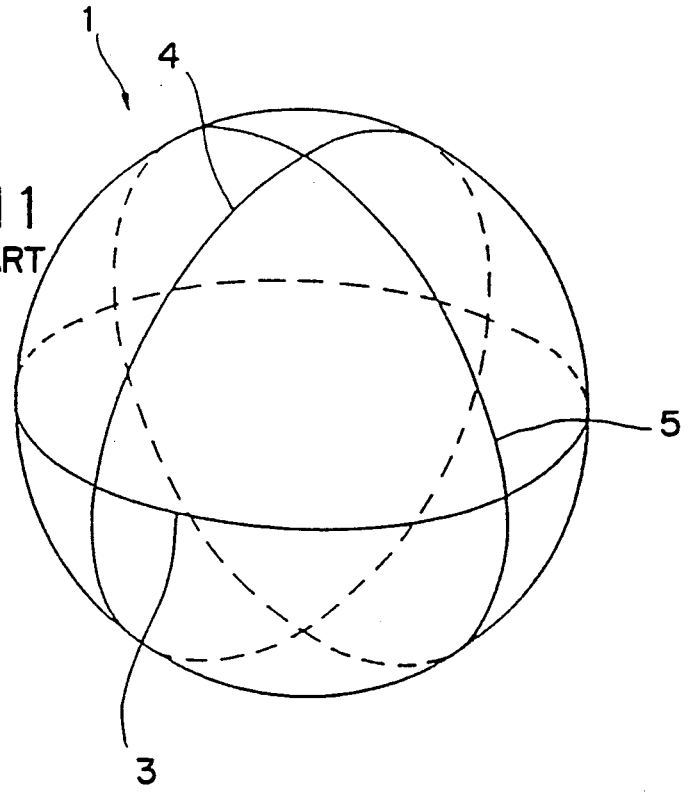
FIG. 11 PRIOR ART
FIG. 11 is a schematic perspective view showing a golf ball having regular octahedral dimple arrangement.
Figure 12:
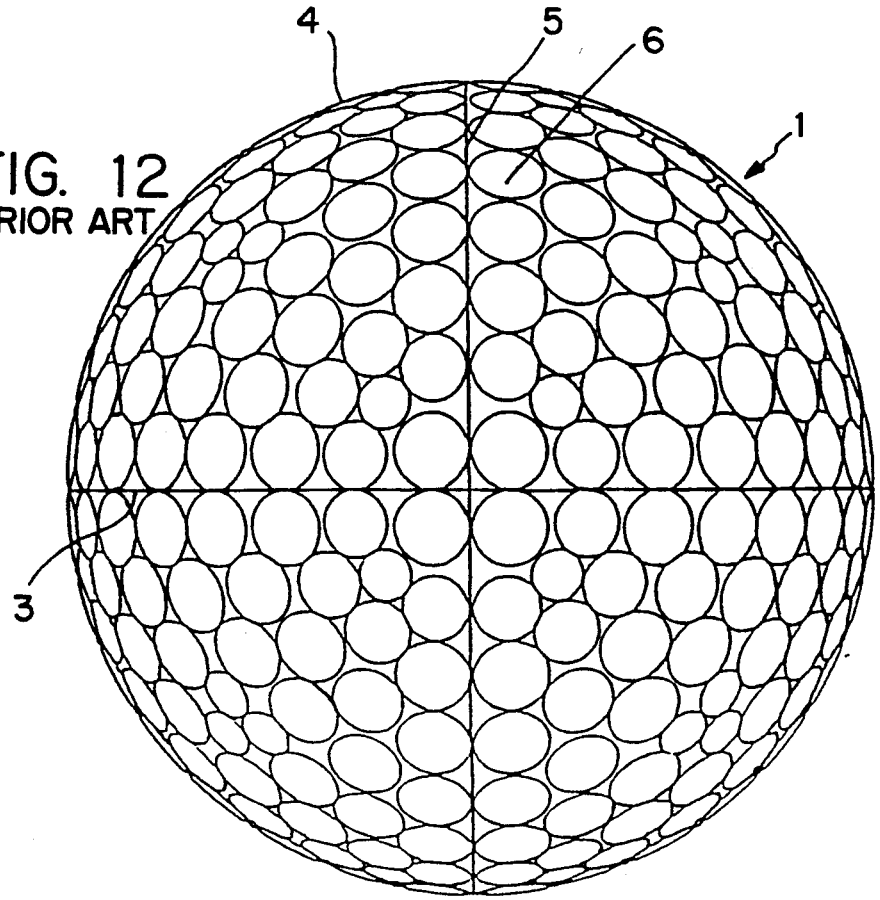
FIG. 12 PRIOR ART
FIG. 12 is a plan view showing a golf ball having a conventional regular octahedral dimple arrangement.

Based on a regular octahedron as shown in FIG. 11, dimples 11 are arranged on the golf ball 10. That is, the seam coincides with one of three great circles 12, 13, and 14 corresponding to the ridge lines, of a regular octahedron which inscribes the imaginary spherical surface of the golf ball 10, projected on the spherical surface of the golf ball 10. That is, the great circle 12 does not intersect the dimples 11 while the great circles 13 and 14 intersect the dimples 11.

Since the golf ball 10 has a regular octahedron on, the golf ball 10 has on the surface thereof eight spherical equilateral triangles I through VIII. According to this embodiment, dimples 11 are arranged equivalently in each eight triangles I through VIII. The dimples 11 consist of eight kinds A through H as shown in Table 1. The diameter of the dimple A is identical to that of the dimple B. The diameter of the dimple C is identical to that of the dimple D; the diameter of the dimple E is identical to that of the dimple F; and the diameter of the dimple G is identical to that of the dimple H. But the depths, curvatures, and volumes of the dimples A and B are different from each other; those of the dimple C are different from those of the dimple D; those of the dimple E are different from those of the dimple F; and those of the dimple G are different from those of the dimple H.

Figure 2:
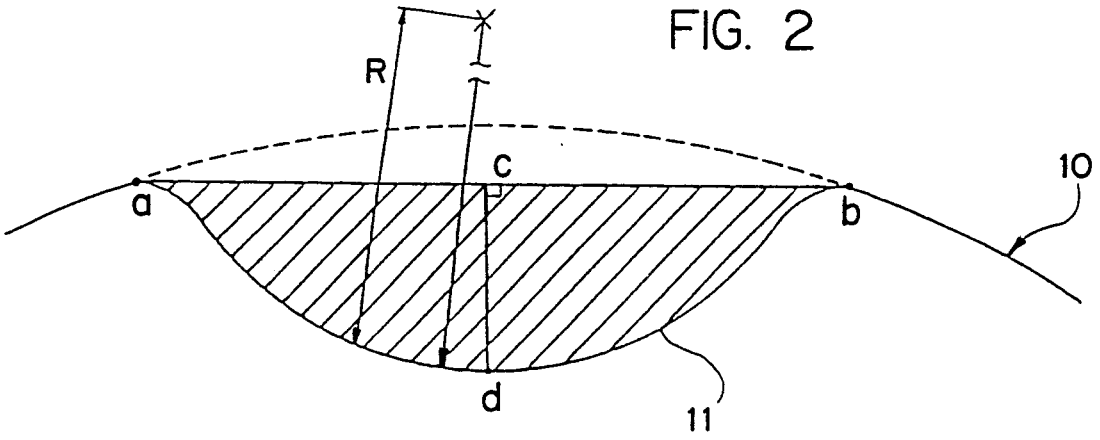
FIG. 2 is a schematic view for explaining a dimple specification.

As shown in FIG. 2, according to the dimple specification of Table 1, diameter is the length of a common tangent to both end points (a) and (b) of the dimple 11; depth is the length longest of perpendiculars dropped from the above tangent to the surface of the dimple 11, namely, the length from point (c) to (d); curvature is the radius (R) of a sphere, part of which forms the surface of the dimple 11; and volume is indicated by diagonal lines of FIG. 2.

TABLE 1 dimple specifications between golf balls of the present invention and the comparison examples

| | total number of dimples | kind of dimple | number of dimples | diameter (mm) | depth (mm) | curvature (mm) | volume (mm) | total volume ($mm^3$) S zone | P zone | whole | RS $mm^3/mm^2$ | RP $mm^3/mm^2$ | RS/RP |
|---|---|---|---|---|---|---|---|---|---|---|---|---|---|
| embodiment | 410 | A | 96 | 4.10 | 0.16 | 13.1 | 1.07 | 165.9 | 174.4 | 340.3 | 0.123 | 0.116 | 1.06 |
| | | B | 138 | 4.10 | 0.14 | 14.8 | 0.95 | | | | | | |
| | | C | 16 | 3.70 | 0.16 | 10.6 | 0.88 | | | | | | |
| | | D | 32 | 3.70 | 0.14 | 12.0 | 0.78 | | | | | | |
| | | E | 48 | 3.20 | 0.16 | 8.3 | 0.63 | | | | | | |
| | | F | 16 | 3.20 | 0.14 | 9.4 | 0.55 | | | | | | |
| | | G | 40 | 2.80 | 0.16 | 6.3 | 0.49 | | | | | | |
| | | H | 24 | 2.80 | 0.14 | 7.1 | 0.43 | | | | | | |
| compari- | 416 | A | 200 | 3.95 | 0.17 | 11.6 | 1.04 | 170.6 | 167.0 | 337.6 | 0.109 | 0.128 | 0.85 |

TABLE 1-continued

| | dimple specifications between golf balls of the present invention and the comparison examples | | | | | | | | | | | | |
|---|---|---|---|---|---|---|---|---|---|---|---|---|---|
| | total number of dimples | kind of dimple | number of dimples | diameter (mm) | depth (mm) | curvature (mm) | volume (mm) | total volume ($mm^3$) S zone | P zone | whole | RS $mm^3/mm^2$ | RP $mm^3/mm^2$ | RS/RP |
| son | | B | 216 | 3.00 | 0.17 | 6.7 | 0.60 | | | | | | |

According to the golf ball 10, as shown in FIG. 1A, eight kinds of dimples 11 are arranged equivalently in each of the eight spherical equilateral triangles I through VIII so that the dimples 11 are symmetrical with respect to each of the great circles 12, 13, and 14 corresponding to the ridge lines of a regular octahedron inscribing the imaginary spherical surface of the golf ball 10 on which the ridge lines are projected. More specifically, each of the great circles 13 and 14 bisects dimples 11-1. That is, each of the dimples 11-1 on the great circles 13 and 14 is divided equivalently into two portions by the great circles 13 and 14 respectively and is arranged in adjacent equilateral triangles. While the dimples 11 which are adjacent to the great circle 12 and are not arranged on the great circle 12 are symmetrical with respect thereto as shown in FIG. 1B.

Figure 3A:
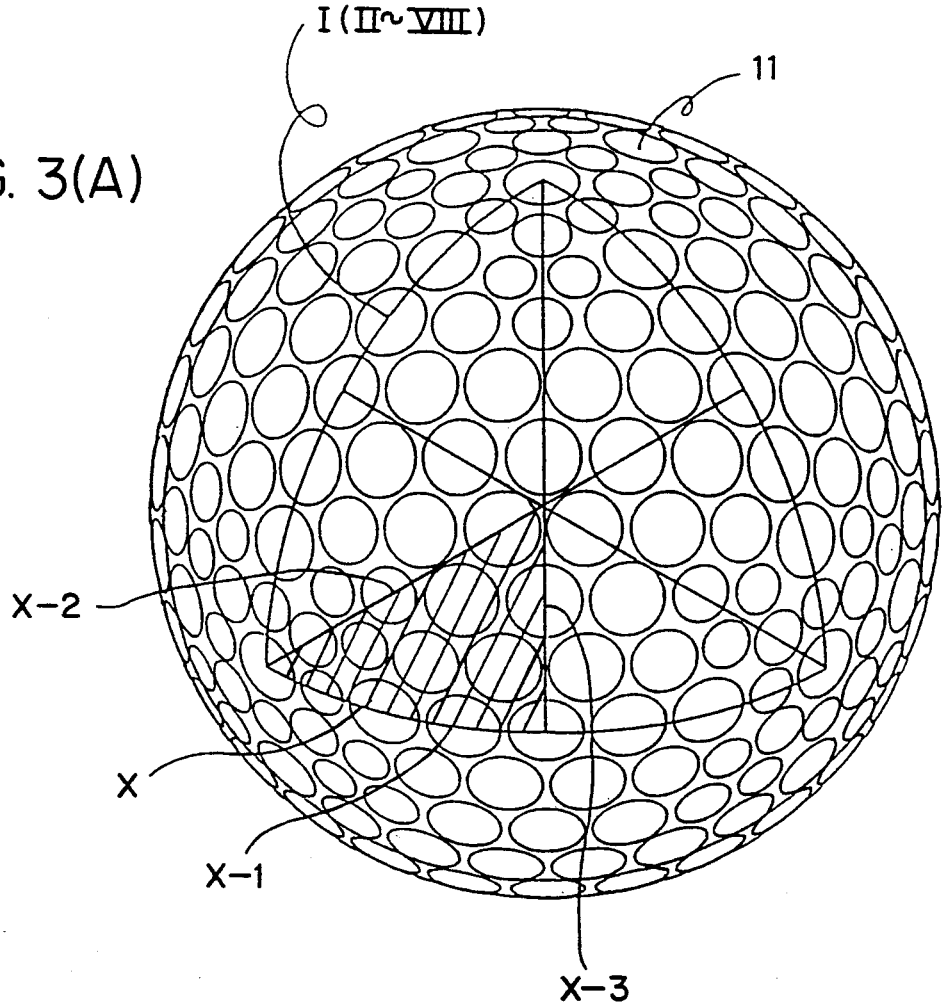
FIG. 3A is a view showing a design stage of the golf ball according to the present invention.
Figure 3B:
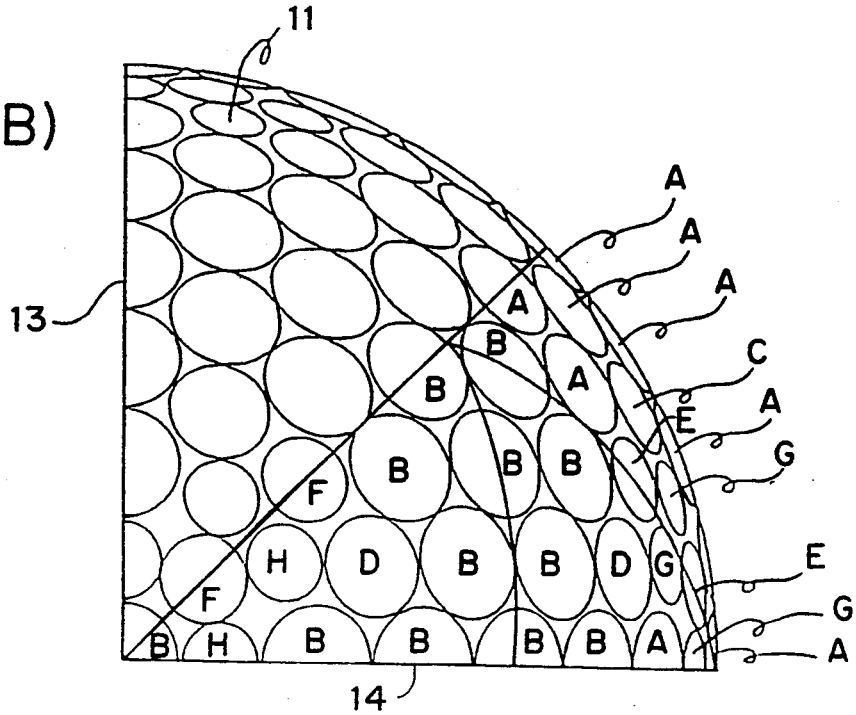
FIG. 3B is an enlarged view showing principal portions obtained when designing of a golf ball has been completed.
Figure 4A:
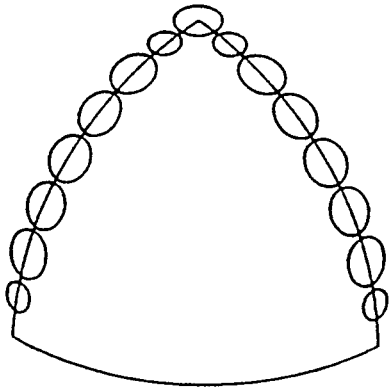
FIGS. 4A and 4B are schematic views each showing a manner for forming a great circle unintersecting dimples.
Figure 4B:
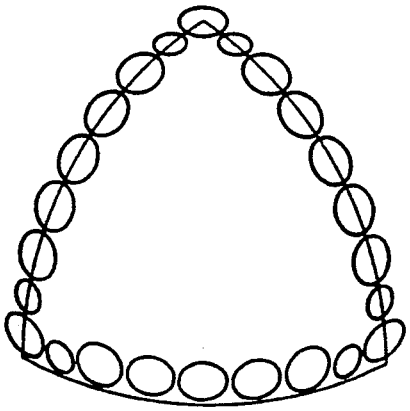

As shown in FIG. 3A, dimples are arranged equivalently in each of the eight equilateral triangles as follows: First, each of the eight equilateral triangles formed according to a regular octahedron is divided into six congruent spherical triangles, so that the spherical surface of the golf ball is divided into 48 congruent triangles. Then, assuming that one of the 48 triangles is a unit triangle X, dimples 11 are arranged on each side X-1, X-2, and X-3 of the triangle X so that they intersect each side X-1, X-2, and X-3. As shown in FIG. 3B, the dimples 11 are arranged in each of the 48 unit triangles so that each triangle has the same dimple arrangement as that of triangle X. According to this design, the golf ball 10 has dimples arranged equivalently in each of the eight spherical equilateral triangles and no great circles unintersecting dimples. However, as described above, dimples cannot be arranged on the seam because it is necessary to remove a burr formed on the seam between a pair of semispherical upper and lower molds. Therefore, dimples which are to be formed on the great circle corresponding to the seam are removed as shown in FIG. 4A or moved as shown in FIG. 4B or a dimple arrangement is redesigned to form only one seam corresponding to the great circle 12 unintersecting dimples in combination of dimple movement and removal. The movement or removal of dimples which are to be formed on the seam great circle corresponding to the seam results in intersections of dimples and the formation of bald areas. In order to overcome this problem, fine adjustments such as movements of dimples inside each of the eight spherical equilateral triangles, size alterations and additions of dimples are carried out so that dimples are equivalently arranged in each spherical equilateral triangle.

According to the above method, the golf ball 10 has the great circle 12 corresponding to the seam which does not intersect the dimples 11, two great circles 13 and 14 intersecting the dimples 11, and the dimples 11 equivalently arranged in each of the eight spherical equilateral triangles.

As shown in FIG. 5, the length L of the dimple 11 intersecting the great circles 13 and 14 and protruding from the spherical equilateral triangle I to the adjacent spherical equilateral triangle II is favorably, more than 0.3 mm, and more favorably, 0.8 mm. In this embodiment, the length L of the dimple 11 is more than 1.4 mm.

The number of dimples 11-1 which intersect the great circles 13 and 14 respectively is at least two, favorably eight or more, and more favorably, 30 or more. According to this embodiment, 34 dimples 11-1 intersect both the great circles 13 and 14, respectively.

In addition to the embodiment as shown in FIGS. 1 and 5, dimples may intersect the great circle 13 and 14 as shown in FIGS. 6A, 6B, FIGS. 7A, 7B, and 7C in which one-quarter of the great circle 13 between the seam 12 and the pole P is shown.

Referring to FIG. 6A, two dimples intersect the great circles 13 and 14, respectively. In FIG. 6B, eight dimples intersect the great circles 13 and 14, respectively. FIGS. 6A and 6B show an example in which the dimples 11 are equivalently arranged in each of the eight spherical equilateral triangles.

Referring to FIGS. 7A, 7B, and 7C, the dimples 11-1 are not equivalently arranged in each of the eight spherical equilateral triangles. FIG. 7A shows an example in which four dimples 11-1 intersect the great circles 13 and 14, respectively. FIG. 7B shows an example in which the dimples 11-1 intersect the great circles 13 and 14 in three patterns (i), (ii), and (iii). In pattern (i), the great circle 13 passes through the center of the dimple 11-1. In pattern (ii), the dimples at the right and left sides with respect to the great circle intersects the great circles 13 and 14, respectively, thus projecting from one spherical equilateral triangle to the adjacent triangle and overlapping with another dimple protruding similarly. In pattern (iii), the dimple 11-1 projects from one triangle to the adjacent triangle in a manner similar to the pattern (ii), but the patter (iii) differs from pattern (ii) in that the dimple 11-1 protrudes from only one triangle to the other triangle and the projecting length thereof is less than one-half of the radius thereof. In this embodiment of FIG. 7B, the great circles 13 and 14 intersect 36 dimples, respectively. Referring to FIG. 7C, the great circles 13 and 14 intersect 16 dimples, respectively.

Figure 8:
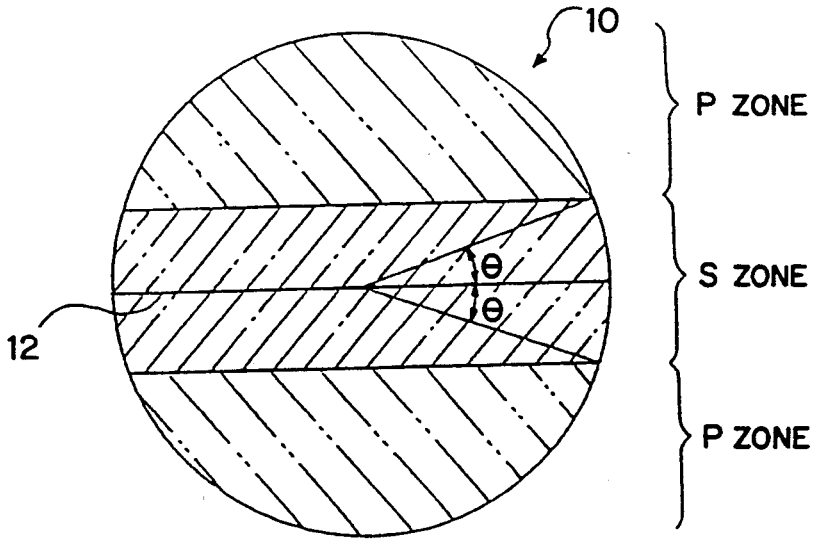
FIG. 8 is schematic view showing the relationship between P zone and S zone of the surface of a golf ball.

In the golf ball having the great circle 12 formed thereon, when the great circle 12 coincides or approximately coincides with a circumference which rotates fastest in its backspin, the dimple effect is reduced and as such, the trajectory becomes low and the flight distance becomes short. In order to solve this problem, the following construction is provided: The surface of the golf ball 10 is divided into two zones, namely, an S spherical zone in the vicinity of the poles P as shown in FIG. 8. The volume of the dimple in S zone is greater than that of the dimple in P zone while the diameters of both dimples are equal to each other. More specifically, as shown by one-dot chain lines, S zone ranges from the great circle 12 to each of circumferences formed in correspondence with a central angle $\theta$ ($10° \leqq \theta < 60°$) with respect to the seam. As shown by two-dot chain lines, P zone ranges from each of the circumferences corresponding to the central angle $\theta$ to the poles P. Assuming that a value RS is obtained by dividing the total volume of all dimples arranged in S zone by the surface area of S zone of the imaginary sphere and that a value RP is obtained by dividing the total volume of all dimples arranged in P zone by the surface area of P zone of the imaginary sphere, RS/RP is set as follows:

$$0.95 \leqq RS/RP \leqq 1.20$$

For example, supposing that the dimple A and the dimple B have the same diameter of 4.1 mm, the greater volume dimple A is arranged in S zone and the smaller volume dimple B is arranged in P zone.

In this embodiment, the spherical surface of the golf ball is divided into S zone and P zone at an angle of 30° and the total volume of all dimples arranged in S zone is 165.9 $mm^3$. The value RS obtained by dividing the dimple volume 165.9 $mm^3$ by the surface area of S zone of the imaginary sphere is 0.123 $mm^3/mm^2$. The total volume of all dimples arranged in P zone is 174.4 $mm^3$. The value RP obtained by dividing the dimple volume 174.4 $mm^3$ by the surface area of P zone of the imaginary sphere is 0.116 $mm^3/mm^2$. Therefore, RS/RP is 1.06 which satisfies the range between 0.95 and 1.20 as described above. If RS/RP is less than 0.95, the trajectory of the golf ball becomes low when the great circle 12 coincides or approximately coincides with a circumference which rotates fastest in its backspin. If RS/RP is more than 1.20, the trajectory of the golf ball becomes too high.

The reason the central angle $\theta$ which divides the surface of the golf ball into S zone and P zone is 10° or more and less than 60° is as follows: If the central angle $\theta$ is less than 10°, dimples are arranged in an extremely small number in S zone. Consequently, the division of the surface of the golf ball into S zone and P zone has no meaning and the differentiation of dimple volume has no effect either. If the central angle $\theta$ is more than 60°, the dimple effect of S zone is greater than that of P zone, and consequently, the aerodynamic symmetrical property cannot be improved. Accordingly, the central angle $\theta$ is appropriately set at the angle of 10° or more than 10° and less than 60° in consideration of the dimple arrangement, the construction of the golf ball, and mixing proportion of materials of the golf ball.

EXPERIMENT 1

The flight performance tests of the golf ball according to the present invention and comparison golf ball, or conventional golf ball were conducted.

Figure 9A:
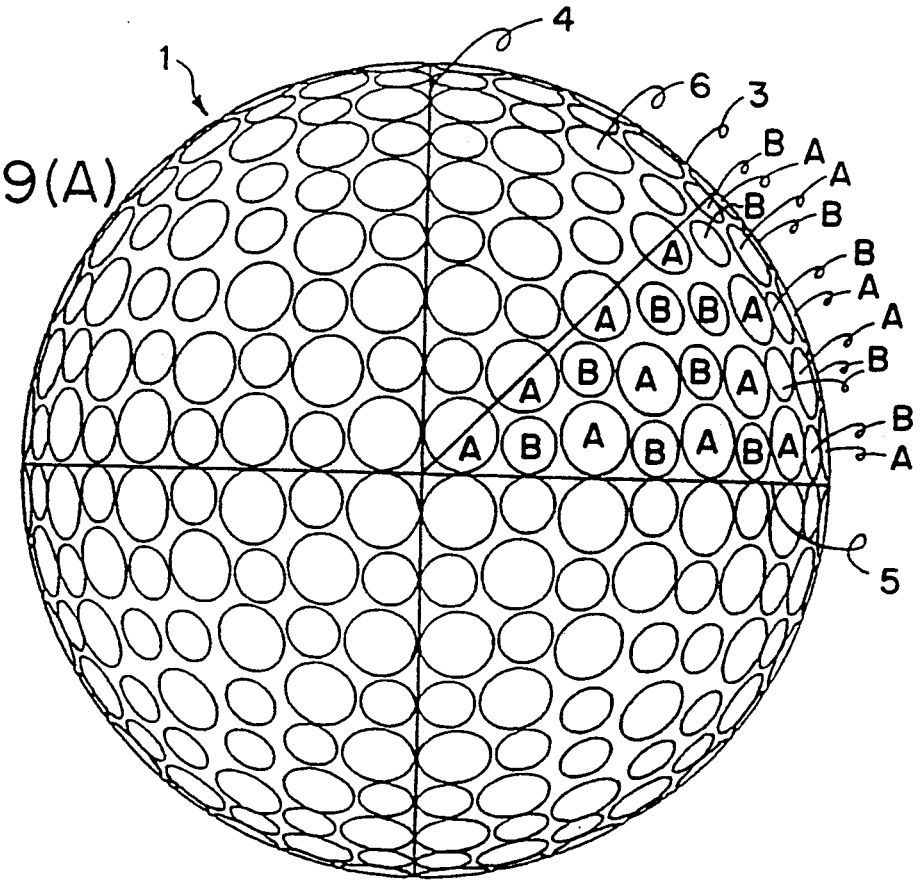
FIG. 9A is a plan view showing a comparison golf ball.
Figure 9B:
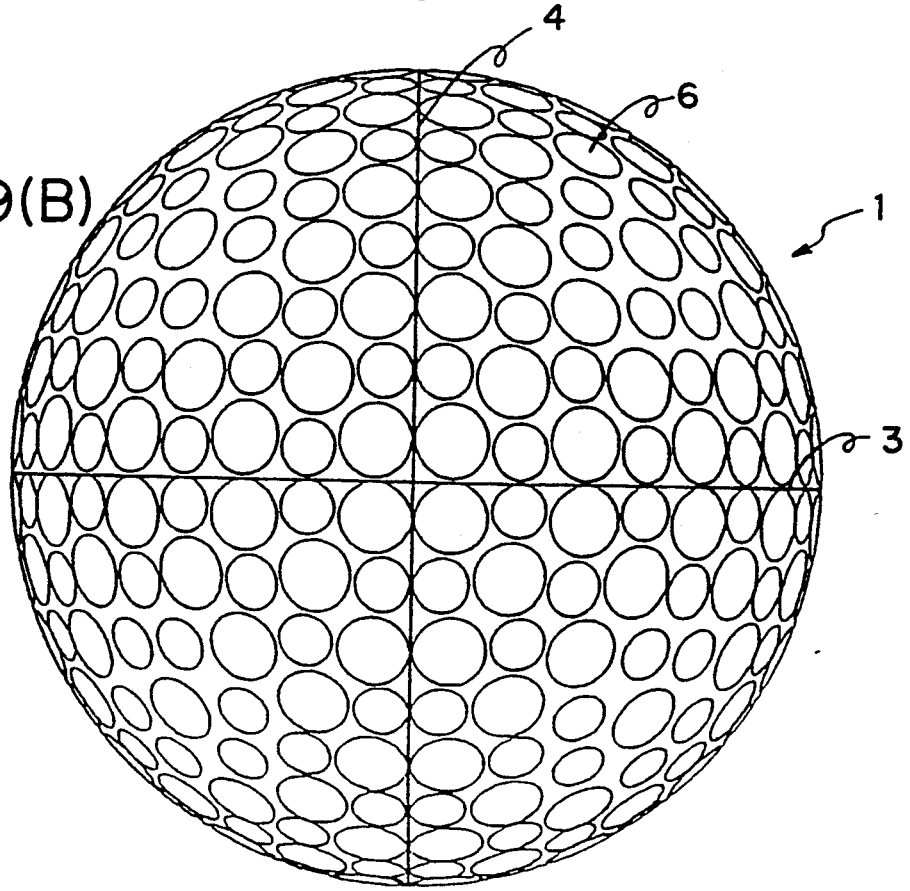
FIG. 9B is front view showing the golf ball of FIG. 9A.
Figure 9C:
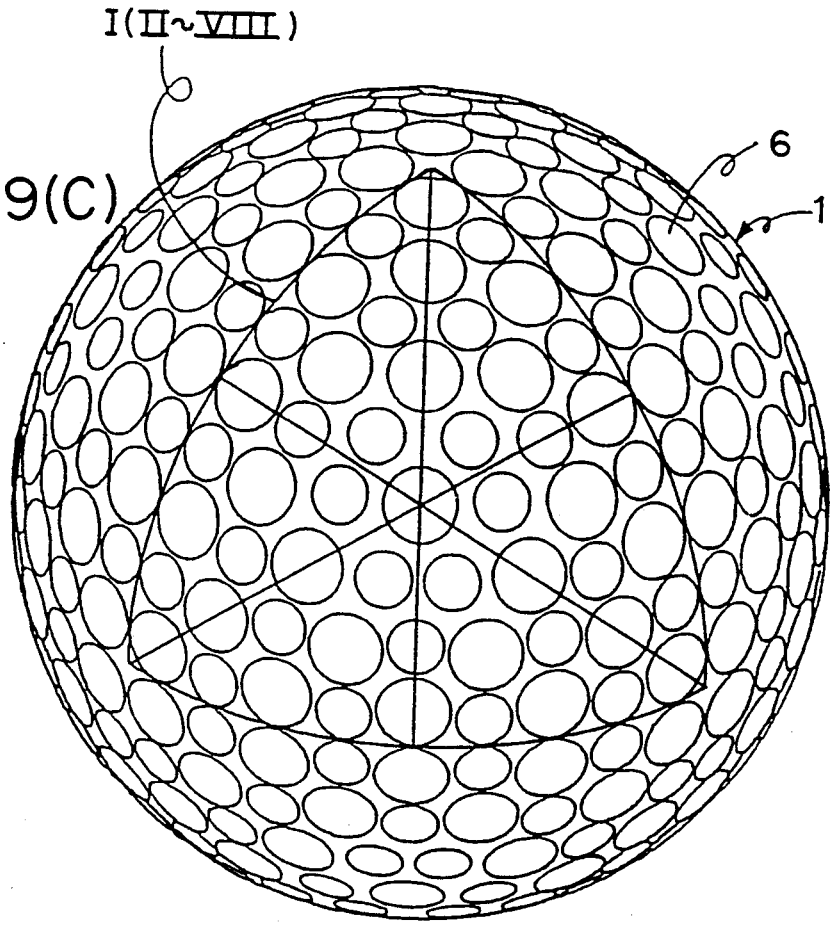
FIG. 9C is a view showing dimples arranged in a spherical equilateral triangle of a comparison golf ball.
Figure 10:
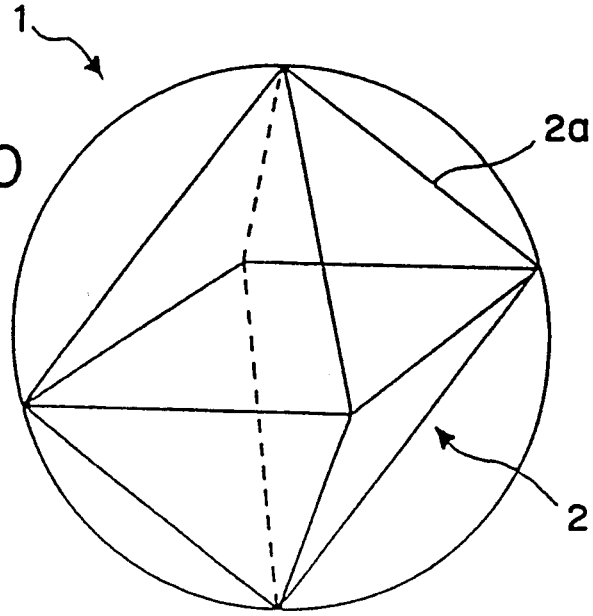
FIG. 10 is a schematic view showing the concept of regular octahedral dimple arrangement.

Comparison golf balls 1 having a dimple specification as shown in Table 1 and FIGS. 9A, 9B, and 9C were prepared. The comparison golf balls 1 have regular octahedral arrangement and three great circles 3, 4, and 5 not intersecting dimples. The volume of dimples of the comparison golf balls 1 arranged in S and P zones are not differentiated. Accordingly, RS/RP is as small as 0.85.

Each of the golf balls according to the present invention as shown in FIG. 1 and comparison golf balls as shown in FIG. 9 has a liquid center wound with thread covered with a balata cover. Both golf balls have the same construction and mixing proportion of materials. The outer diameter is each 42.70±0.03 mm and compression is each 95±2.

Flight test of the balls according to the present invention and comparison golf balls were conducted using a swing robot manufactured by True Temper Corp. Balls were hit by a driver (No. 1 wood) at a head speed of 45 m/s. Spin was 3500±300 rpm and a ball launching angle was 10±0.5°. Wind was fair at a speed of 0.6~2.8 m/s.

The number of the golf balls of the embodiment and the comparison golf balls prepared was 20, respectively. The temperature thereof was kept at 23°±1° C. The golf balls of the embodiment and the comparison golf balls were alternately hit.

The carry, total, and duration of flight of the golf balls of the embodiment and comparison golf balls shown in Table 2 are the average of those of 20 golf balls.

"Carry" shown in Table 2 is the distance from a hitting point to a falling point; "total" is the distance from the hitting point to the point at which each golf ball stopped; and "trajectory height" is an angle of elevation viewed from the launching point of each golf ball to the highest point thereof in trajectory.

TABLE 2

| | Flight distance test | | | |
|---|---|---|---|---|
| | carry (yard) | total (yard) | trajectory height (DEG) | flight duration (SEC) |
| embodiment | 228.5 | 245.3 | 13.30 | 5.30 |
| comparison | 224.2 | 242.0 | 13.18 | 5.21 |

TABLE 3

| | Symmetrical property test | | | | |
|---|---|---|---|---|---|
| | kind of hitting | carry (yard) | total (yard) | trajectory height (DEG) | flight duration (SEC) |
| embodiment | pole | 245.5 | 260.2 | 13.72 | 5.87 |
| | seam | 244.9 | 260.5 | 13.67 | 5.87 |
| comparison | pole | 242.6 | 254.6 | 13.57 | 5.79 |
| | seam | 238.8 | 256.0 | 13.20 | 5.46 |

As shown in Table 2, the golf ball of the embodiment traveled further than the golf ball of the comparison golf ball by 4.3 yards in carry and by 3.3 yards in "total". It was confirmed from this result that in flight distance, the golf ball of the embodiment having one great circle formed thereon is superior to the comparison golf ball having three great circles.

EXPERIMENT 2

Symmetrical test was conducted on the golf balls according to the embodiment and the comparison golf balls used in example 1, employing a swing robot manufactured by True Temper Corp. The golf balls were hit by a driver at a head speed of 48.8 m/s. Spin was 3500±300 rpm; ball launching angle was 9°±0.5°. Wind was fair at a speed of 0.3~2.2 m/s. The number of the embodiment golf balls and the comparison golf balls was 40 respectively, 20 ball were used each for pole hitting and seam hitting. The temperature thereof was kept at 23° C.±1° C.

According to seam hitting, a rotational axis is selected so that a circumference which rotates fastest in its backspin coincides with the seam. According to pole hitting, a circumference perpendicular to the rotational axis in seam-hitting functions as the rotational axis of the backspin.

As shown in Table 3 indicating the result of the symmetrical property test, the golf balls of the embodiment had little difference in carry, total, trajectory height, and duration of flight between seam hitting and pole hitting. On the other hand, according to the comparison golf balls, the trajectory height in seam hitting was lower than that in pole hitting, and the duration of flight and carry in seam hitting were shorter than those in pole hitting.

It was confirmed from the above result that dimple effect is not reduced even in seam hitting and a golf ball having a favorable symmetrical property can be obtained owing to the differentiation of dimple volumes in S zone and P zone as described previously.

That is:

$$0.95 \leqq RS/RP \leqq 1.20$$

As apparent from the foregoing description, without damaging a favorable symmetrical property and fine view of regular octahedral dimple arrangement, the golf ball in accordance with the present invention is capable of achieving a flight performance more favorable than that of the conventional golf ball. That is, since the golf ball has only one great circle corresponding to the seam not intersecting dimples, the possibility that a circumference which rotates fastest in its backspin coincides or approximately coincides with the great circle is reduced, so that the flight distance of the golf ball can be increased.

In addition, the surface of the golf ball is divided into two zones. One is in the vicinity of the great circle unintersecting dimples and the other is in the vicinity of the poles. The volumes of dimples are differentiated according to each zone so as to improve the difference in the aerodynamic symmetrical property of the golf ball between seam hitting and pole hitting. Accordingly, the trajectory of the golf ball is not varied so much even though the golf ball spins about a varied rotational axis. As such, the golf ball is capable of faithfully display a player's ability, thus contributing to the improvement of player's skill. Further, since the golf ball has only one great circle corresponding to the seam, an upper mold is rotated with respect to a lower mold so as to design various dimple arrangement without affecting the flight performance thereof.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball comprising dimples arranged in eight spherical equilateral triangles obtained by projecting, on an imaginary spherical surface of said golf ball, the ridge lines of a regular octahedron inscribing said imaginary spherical surface, between 300 to 550 dimples being provided on the golf ball, three great circles corresponding to said ridge lines being projected on said spherical surface, one great circle coinciding with a mold seam being formed as a sole great circle unintersecting dimples and the other two great circles intersect dimples, the dimples being equivalently arranged in each of said eight spherical equilateral triangles.

2. The golf bass as claimed in claim 1, wherein the dimple specification of an S spherical zone in a vicinity of said seam and a P spherical zone in a vicinity of poles are set in the range of $0.95 \leqq RS/RP \leqq 1.20$ for each hemisphere of the golf ball where RS is a value obtained by dividing the total volume of all dimples arranged in said S spherical zone by the area of said S spherical zone of said imaginary spherical surface; and RP is a value obtained by dividing the total volume of all dimples arranged in said P spherical zone by the area of said P spherical zone of said imaginary spherical surface.

* * * * *